US005816722A

United States Patent [19]

Fujiwara et al.

[11] Patent Number: 5,816,722

[45] Date of Patent: Oct. 6, 1998

[54] PRINTER AND TRACTOR DEVICE THEREFOR

[75] Inventors: Tsutomu Fujiwara, Shizuoka; Tsuyoshi Sanada, Susono, both of Japan

[73] Assignee: Kabushiki Kaisha TEC, Shizuoka, Japan

[21] Appl. No.: 934,566

[22] Filed: Sep. 22, 1997

Related U.S. Application Data

[63] Continuation of Ser. No. 553,016, Nov. 3, 1995, abandoned.

[30] Foreign Application Priority Data

Nov. 11, 1994 [JP] Japan ..... 6-277562
Feb. 17, 1995 [JP] Japan ..... 7-029224

[51] Int. Cl.[6] ..... B41J 11/00

[52] U.S. Cl. ..... 400/605; 400/616; 400/616.1; 400/624

[58] Field of Search ..... 400/605, 616, 400/616.1, 616.2, 617, 622, 624

[56] References Cited

U.S. PATENT DOCUMENTS 4,688,957 8/1987 Prevignano ..... 400/605
5,037,222 8/1991 Quick et al. ..... 400/605
5,139,355 8/1992 Yeager ..... 400/605
5,169,250 12/1992 Tsuru et al. ..... 400/605
5,308,175 5/1994 Ito ..... 400/605

FOREIGN PATENT DOCUMENTS 3-222771 10/1991 Japan .
4-115967 4/1992 Japan .
4-355170 12/1992 Japan .

*Primary Examiner*—John S. Hilten
*Attorney, Agent, or Firm*—Oblon, Spivak, McClelland, Maier & Neustadt, P.C.

[57] ABSTRACT

A printer allowing attachment and detachment of an external device for improving a paper feed system. The printer allows either an automatic sheet feeder for successively feeding a plurality of cut sheets of paper or a tractor device for feeding a continuous sheet of paper as the external device to be selectively mounted, and the printer itself includes a permanent tractor, in which the permanent tractor and the external device can be driven by a common driving source. More specifically, the printer includes a printing mechanism, a paper feed path communicating with the printing mechanism, a driving source for the paper feed system, and an output gear connected to an output shaft of the driving source. The permanent tractor is located so as to communicate with the paper feed path, and includes an input gear connected to the output shaft of the driving source. The selective transmission of a drive force from the driving source to either the input gear of the permanent tractor or the output gear is effected by a drive force selecting mechanism operated by an operating member in the printer.

41 Claims, 17 Drawing Sheets

PRINTER AND TRACTOR DEVICE THEREFOR

This application is a Continuation of application Ser. No. 08/553,016, filed on Nov. 3, 1995, now abandoned.

BACKGROUND OF THE INVENTION

1. Field of the Invention

The present invention relates to a printer which allows both a cut sheet of paper and a continuous sheet of paper to be set therein and allows one of the two kinds of sheets to be selectively fed to a printing mechanism, and also relates to a tractor device as an external device adapted to be attached to such a printer. More particularly, the present invention relates to a printer which allows attachment and detachment of an external device for enriching the kind of a paper feed system, and also relates also to a tractor device as such an external device.

2. Description of the Prior Art

Known is a printer provided with a tractor and a friction feed mechanism to selectively use as a printing sheet either a continuous sheet of paper having many tractor holes arranged with equal pitches along both side edges or a cut sheet of paper. The tractor has a structure such that a rotating member having a plurality of pins projecting from the outer circumference for engagement with the tractor holes of the continuous sheet is rotated to feed the continuous sheet. On the other hand, the friction feed mechanism has a structure such that a drive roller and a pinch roller supported separatably from the drive roller are rotated to feed the cut sheet.

There are various kinds of cut sheets of paper different in size. Such different kinds of cut sheets are stacked in various kinds of paper feed cassettes according to the different sizes, and the cut sheets in each paper feed cassette are fed one by one. Accordingly, the different kinds of cut sheets can be easily set in the printer. On the other hand, there are also various kinds of continuous sheets of paper. However, setting of each kind of continuous sheet to the tractor is troublesome. Accordingly, it is convenient that the printer is to be provided with plural kinds of tractors to allow quick change from one kind of continuous sheet into another.

In view of such a standpoint, as shown in FIGS. 17 and 18, a tractor 101 built in a printer 100 is usually used to feed a continuous sheet 102 to a printing section (not shown), and in the case of selectively using either the continuous sheet 102 or another continuous sheet 103, an optional tractor device 105 having a tractor 104 is adapted to the printer 100. When the tractor device 105 is attached to the printer 100, the continuous sheet 103 is fed by the tractor 104 to the printing section.

The tractor 101 in the printer 100 or the tractor 104 in the tractor device 105 includes a pair of right and left holders 108 slidably supported on a rotating shaft 106*a* or 106*b* and a guide shaft 107, a pulley (not shown) provided on each holder 108 so as to be driven by the rotating shaft 106*a* or 106*b*, an endless belt (not shown) wound around each pulley, and a paper presser 109 erectably mounted on each holder 108. The outer circumference of each endless belt is formed with a plurality of pins (not shown) adapted to engage a plurality of tractor holes formed along both side edges of the continuous sheet 102 or 103.

The tractor 101 or 104 is driven by a drive gear 110 provided in the printer 100. When the tractor 104 in the optional tractor device 105 is to be driven, rotation of the drive gear 110 is transmitted through gears 111, 112, and 113 and a shift gear 114 to an input gear 115 fixed to one end portion of the rotating shaft 106*b* of the tractor 104. On the other hand, when the tractor 101 in the printer 100 is to be driven, the rotation transmitted from the drive gear 110 to the gear 113 is transmitted through the shift gear 114 and gears 117 and 118 to an input gear 119 fixed to one end portion of the rotating shaft 106*a* of the tractor 101 as shown in FIG. 18. The pair of the gears 111 and 119, the pair of the gears 112 and 118, and the pair of the gears 113 and 117 are coaxially arranged in each pair, but are rotatable with no restriction to each other in each pair.

The shift gear 114 is axially slidably supported, so as to selectively transmit the rotation of the gear 113 to either the input gear 115 or the gear 117. As shown in FIG. 17, a slider 120 is slidably supported inside of the printer 100 so as to be slid in a direction perpendicular to the axial direction of the shift gear 114. The slider 120 is normally biased obliquely upward toward the depth of the printer 100. The slider 120 is connected at a lower end thereof through a wire 123 to a plunger 122 of a solenoid 121 provided in the tractor device 105. One side surface of the slider 120 is formed with a mountainous projection (not shown), and the shift gear 114 is normally biased so as to mesh with the gear 117. When the solenoid 121 is excited to retract the plunger 122, the slider 120 is pulled by the wire 123 to slide downward. As a result, the shift gear 114 is urged by the side projection of the slider 120 to come into mesh with the input gear 115.

There will now be described problems in the prior art. In the conventional printer 100 as shown in FIGS. 17 and 18, if only the built-in tractor 101 is to be driven, it would be necessary to merely connect the input gear 119 fixed to one end of the rotating shaft 106*a* of the tractor 101 through a single gear to the drive gear 110. However, to allow the optional tractor device 105 to be selectively driven, the plural gears are coaxially arranged. Accordingly, a power transmission structure is complicated, and the lateral size of the printer 100 is increased. Further, if the width of the printer 100 is limited, the width of a continuous sheet to be used is also limited.

Japanese Patent Laid-open No. Hei 4-115967 (laid open on Apr. 16, 1992) discloses a printer provided with a plurality of tractors and adapted to selectively drive these tractors by a single driving portion. Japanese Patent Laid-open No. Hei 4-355170 (laid open on Dec. 9, 1992) discloses a printer provided with a plurality of detachable tractors and adapted to selectively connect these tractors to a driving portion by operating a lever to select gears.

However, these publications (Japanese Patent Laid-open Nos. Hei 4-115967 and Hei 4-355170) do not contain any disclosure relating to the feed of a cut sheet. Accordingly, the printers disclosed in these publications cannot support various use modes of plural kinds of printing sheets, so that both a cut sheet and a continuous sheet cannot be set in the printer.

Japanese Patent Laid-open No. Hei 3-222771 (laid open on Oct. 1, 1991) discloses a printer provided with a plurality of pairs of tractors upstream in a paper feed direction to feed continuous sheets to the same printing position, wherein at least one pair of tractors are constructed as a unit which is detachable. This printer is further provided with a paper feeder for feeding a cut sheet to the printing position and a press roller adapted to come into pressure contact with a platen. This printer is controlled so that when the cut sheet is to be fed to the printing position by the paper feeder, the press roller is brought into pressure contact with the platen, whereas when the continuous sheet is to be fed to the printing position by the tractor, the contact of the press roller and the platen is canceled.

However, in the printer disclosed in Japanese Patent Laid-open No. Hei 3-222771, a mechanism for driving the tractor is independent of the paper feeder, and the structure is therefore complicated, causing an increase in size of the printer.

SUMMARY OF THE INVENTION

It is accordingly a first object of the present invention to provide a printer and a tractor device therefor which allow the use of plural kinds of printing sheets in various modes.

It is a second object of the present invention to provide a printer and a tractor device therefor which allow the use of plural kinds of printing sheets in various modes with a simple structure.

It is a third object of the present invention to provide a printer and a tractor device therefor which allow the use of plural kinds of printing sheets in various modes without an increase in size.

In accordance with an aspect of the present invention, there is provided a printer allowing attachment and detachment of an external device for enriching the kind of a paper feed system, comprising a printing mechanism; a paper guide path communicating with the printing mechanism; a driving source for the paper feed system; a permanent tractor located so as to communicate with the paper guide path, the permanent tractor having an input gear connected to an output shaft of the driving source, thereby applying a feeding force to a continuous sheet of paper; an output gear connected to the output shaft of the driving source; a drive force selecting mechanism for selectively transmitting a drive force from the driving source to one of the input gear of the permanent tractor and the output gear; an operating member for operating the drive force selecting mechanism; and an external device connecting portion selectively allowing attachment and detachment of one of an automatic sheet feeder for successively feeding a plurality of cut sheets of paper and a tractor device for feeding a continuous sheet of paper so that a paper feed mechanism of one of the automatic sheet feeder and the tractor device communicates with the paper guide path, and the output gear is connected to an input gear of the paper feed mechanism. Accordingly, the printer allows the feed of a continuous sheet of paper by the permanent tractor, the successive feed of a plurality of cut sheets of paper by the automatic sheet feeder mounted in the printer, and the feed of a continuous sheet of paper by the tractor device mounted in the printer in place of the automatic sheet feeder. Thus, the printer can support various use modes of plural kinds of printing sheets. Furthermore, the automatic sheet feeder and the tractor device can be driven by a common driving source, thereby realizing simplification of the structure of the printer and size reduction of the printer.

In accordance with another aspect of the present invention, there is provided a printer allowing attachment and detachment of an external device for enriching the kind of a paper feed system, comprising a printing mechanism; a paper guide path communicating with the printing mechanism; a driving source for the paper feed system; a friction feed mechanism adapted to receive a drive force from the driving source, the friction feed mechanism comprising a drive roller and a pinch roller kept in separable contact with each other through the paper guide path; a permanent tractor located so as to communicate with the paper guide path, the permanent tractor having an input gear connected to an output shaft of the driving source, thereby applying a feeding force to a continuous sheet of paper; an output gear connected to the output shaft of the driving source; a drive force selecting mechanism for selectively transmitting a drive force from the driving source to one of the input gear of the permanent tractor and the output gear; an operating member for operating the drive force selecting mechanism; and an external device connecting portion selectively allowing attachment and detachment of one of an automatic sheet feeder for successively feeding a plurality of cut sheets of paper and a tractor device for feeding a continuous sheet of paper so that a paper feed mechanism of one of the automatic sheet feeder and the tractor device communicates with the paper guide path, and the output gear is connected to an input gear of the paper feed mechanism. Accordingly, the printer allows the feed of a cut sheet of paper by the friction feed mechanism, the feed of a continuous sheet of paper by the permanent tractor, the successive feed of a plurality of cut sheets of paper by the automatic sheet feeder mounted in the printer, and the feed of a continuous sheet of paper by the tractor device mounted in the printer in place of the automatic sheet feeder. Thus, the printer can support various use modes of plural kinds of printing sheets. Furthermore, the automatic sheet feeder and the tractor device can be driven by a common driving source, thereby realizing simplification of the structure of the printer and size reduction of the printer.

In accordance with a further aspect of the present invention, there is provided a tractor device adapted to be detachably mounted in a printer including a printing mechanism, a permanent tractor for feeding a continuous sheet of paper to the printing mechanism, and an automatic sheet feeder detachably mounted for successively feeding a plurality of cut sheets of paper to the printing mechanism; the tractor device comprising a tractor body allowed to be detachably mounted into the printer in place of the automatic sheet feeder; an auxiliary tractor mounted in the tractor device for feeding a continuous sheet of paper to the printing mechanism of the printer; and an input gear connected to the auxiliary tractor, the input gear being adapted to be connected to a drive mechanism provided in the printer for driving the automatic sheet feeder when the tractor body is mounted into the printer. Accordingly, the automatic sheet feeder and the tractor device can be driven by a common driving source, thereby realizing simplification of the structure of the printer and size reduction of the printer.

In accordance with a still further aspect of the present invention, there is provided a tractor device adapted to be detachably mounted in a printer including a printing mechanism, a permanent tractor for feeding a continuous sheet of paper to the printing mechanism, an automatic sheet feeder detachably mounted for successively feeding a plurality of cut sheets of paper to the printing mechanism, and an operating member adapted to be operated to selectively transmit a drive force to one of the permanent tractor and the automatic sheet feeder; the tractor device comprising a tractor body allowed to be detachably mounted into the printer in place of the automatic sheet feeder; an auxiliary tractor mounted in the tractor device for feeding a continuous sheet of paper to the printing mechanism of the printer; and an input gear connected to the auxiliary tractor, the input gear being adapted to be connected to a drive mechanism provided in the printer for driving the automatic sheet feeder when the tractor body is mounted into the printer. Accordingly, the automatic sheet feeder and the tractor device can be driven by a common driving source, thereby realizing simplification of the structure of the printer and size reduction of the printer.

DESCRIPTION OF THE PREFERRED EMBODIMENTS

A first preferred embodiment of the present invention will now be described with reference to FIGS. 1 to 7.

Figure 2:
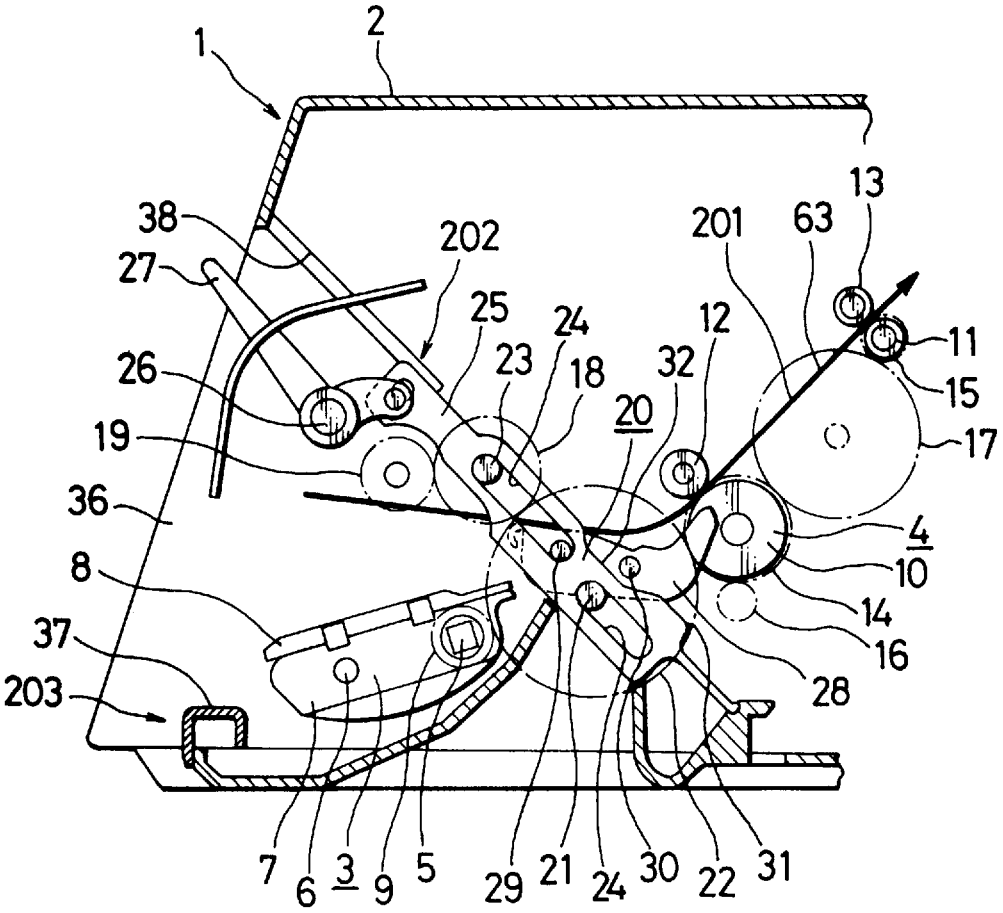
FIG. 2 is a vertical sectional side view showing a condition where a cut sheet of paper is fed by the printer only.
Figure 3:
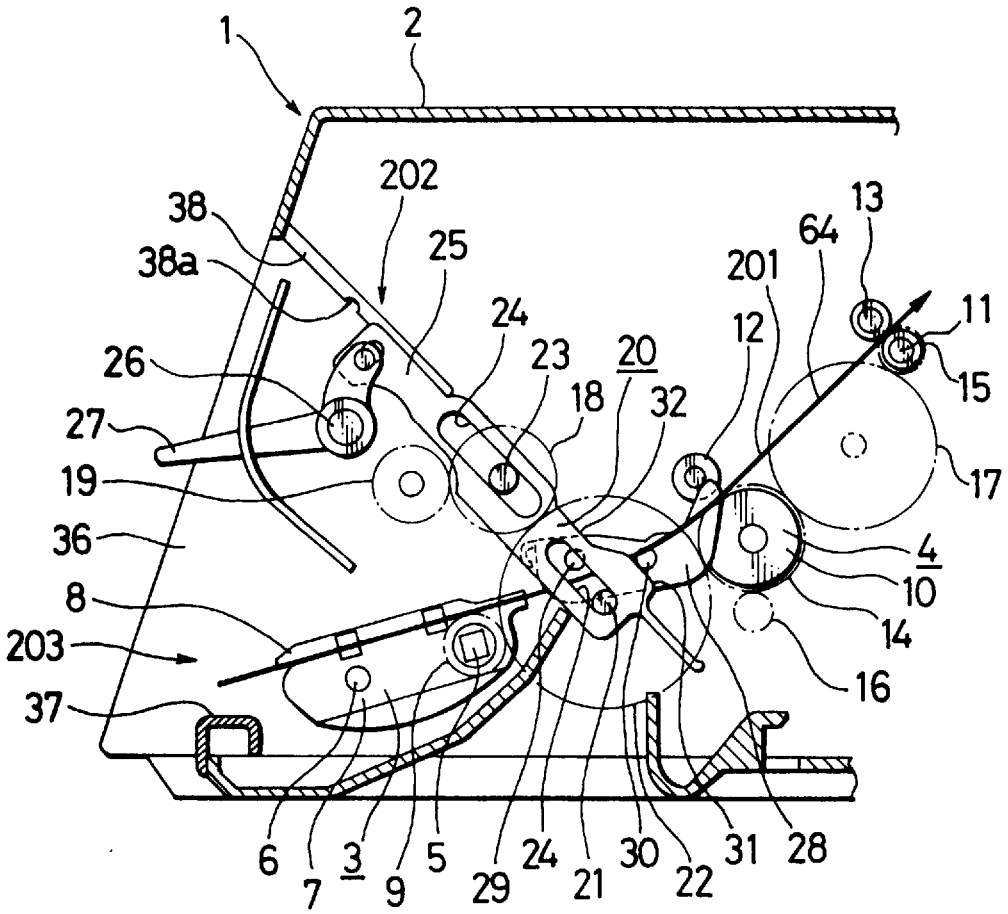
FIG. 3 is a vertical sectional side view showing a condition where a continuous sheet of paper is fed by the printer only.

A printer 1 will now be described. FIGS. 2 and 3 show the internal structure of the printer 1. There are arranged in a printer body 2 of the printer 1 a permanent tractor 3, a friction feed mechanism 4, and a printing mechanism (not shown) in this order from the front side toward the rear side along a paper guide path 201. The permanent tractor 3 includes a pair of right and left holders 7 slidably supported on a rotating shaft 5 and a guide shaft 6, a pulley (not shown) provided on each holder 7 so as to be driven by the rotating shaft 5, an endless belt (not shown) wound around each pulley and having a plurality of pins on the outer circumferential surface, and a paper presser 8 erectably mounted on each holder 7. An input gear 9 is fixedly mounted on one end of the rotating shaft 5. The friction feed mechanism 4 includes drive rollers 10 and 11 and pinch rollers 12 and 13 kept in pressure contact with the drive rollers 10 and 11, respectively. Transmitting gears 14 and 15 are fixedly engaged with the ends of the drive rollers 10 and 11, respectively. The drive roller 10 is rotated by receiving torque of a motor (not shown) as a driving source through a drive gear 16 as a driving portion and the transmitting gear 14. The drive roller 11 is rotated by transmitting rotation of the transmitting gear 14 through a transmitting gear 17 to the transmitting gear 15.

An idler gear 18 and an output gear 19 normally meshing with each other are rotatably provided on one side of the printer body 2. Further, a drive force selecting mechanism 20 is provided on one side of the printer body 2 to selectively transmit rotation of the drive gear 16 to the input gear 9 of the permanent tractor or transmit rotation of the drive gear 16 through the idler gear 18 to the output gear 19. The drive force selecting mechanism 20 includes a shift gear 22 axially slidably supported on a support shaft 21 and a slider cam 25 having an elongated hole 24 guided in linear motion by both a support shaft 23 supporting the idler gear 18 and the support shaft 21. The slider cam 25 is a translation cam mechanism adapted to be linearly moved by rotating an operating member 27 about a support shaft 26.

A separating mechanism 202 will now be described. The separating mechanism 202 is a mechanism for separating the pinch roller 12 from the drive roller 10. An operating member 28 biased clockwise on one side of the printer body 2 is pivotably mounted on a support shaft 29. The operating member 28 has a pin 30 projecting from the side surface. When the pin 30 is urged by a projection 31 of the slider cam 25, the operating member 28 is pivoted counterclockwise about the support shaft 29 to thereby separate the pinch roller 12 from the drive roller 10, whereas when the pin 30 reaches a recess 32 of the slider cam 25 by the sliding operation of the slider cam 25, the operating member 28 is pivoted clockwise to thereby allow the contact of the pinch roller 12 with the drive roller 10.

Figure 5A:
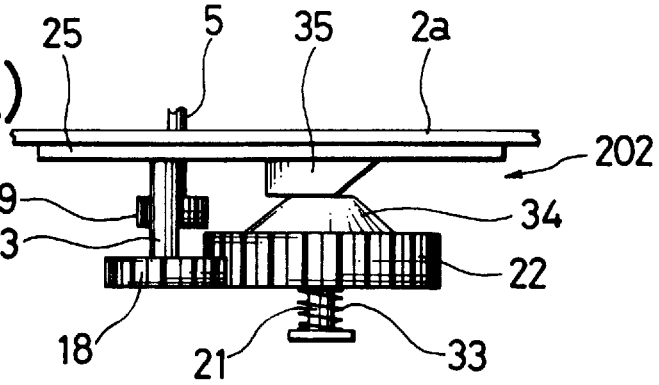
FIG. 5(A) is a plan view showing a condition where an operating member is operated to make a shift gear mesh with an idler gear meshing with an output gear.
Figure 5B:
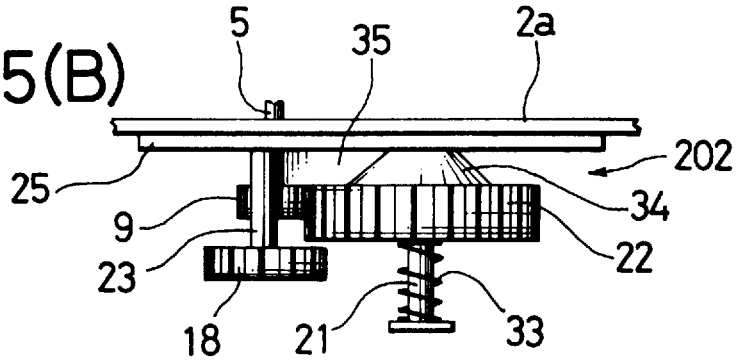
FIG. 5(B) is a plan view showing a condition where the operating member is operated to make the shift gear mesh with an input gear of a permanent tractor.
Figure 5C:
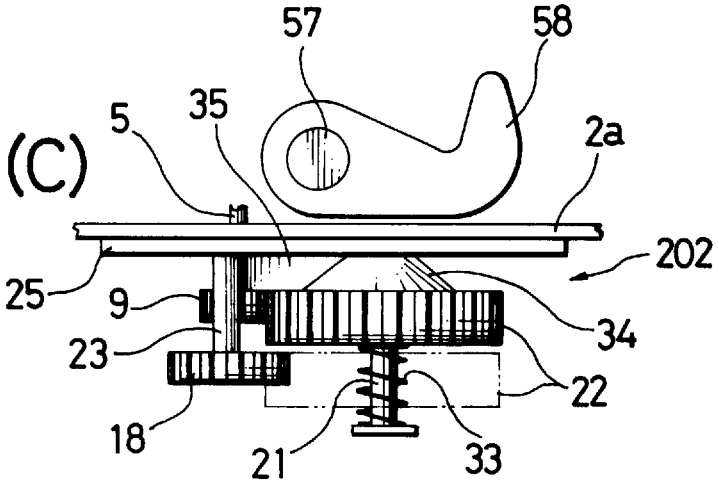
FIG. 5(C) is a plan view showing a positional relation between a cam of a second drive force selecting mechanism provided in the tractor device and the shift gear provided in the printer.

As shown in FIGS. 5(A) to 5(C), the support shaft 23 supporting the idler gear 18 and the support shaft 21 supporting the shift gear 22 extend from a side plate 2*a* of the printer body 2. The support shaft 21 is flanged, and a spring 33 as a means for biasing the shift gear 22 toward the side plate 2*a* is coiled around the support shaft 21. One side surface of the shift gear 22 is provided with a conical projection 34 having a diameter gradually decreasing toward the side plate 2*a*. One side surface of the slider cam 25 is provided with a projection 35 for urging the shift gear 22 away from the side plate 2*a* against the biasing force of the spring 33.

Figure 4:
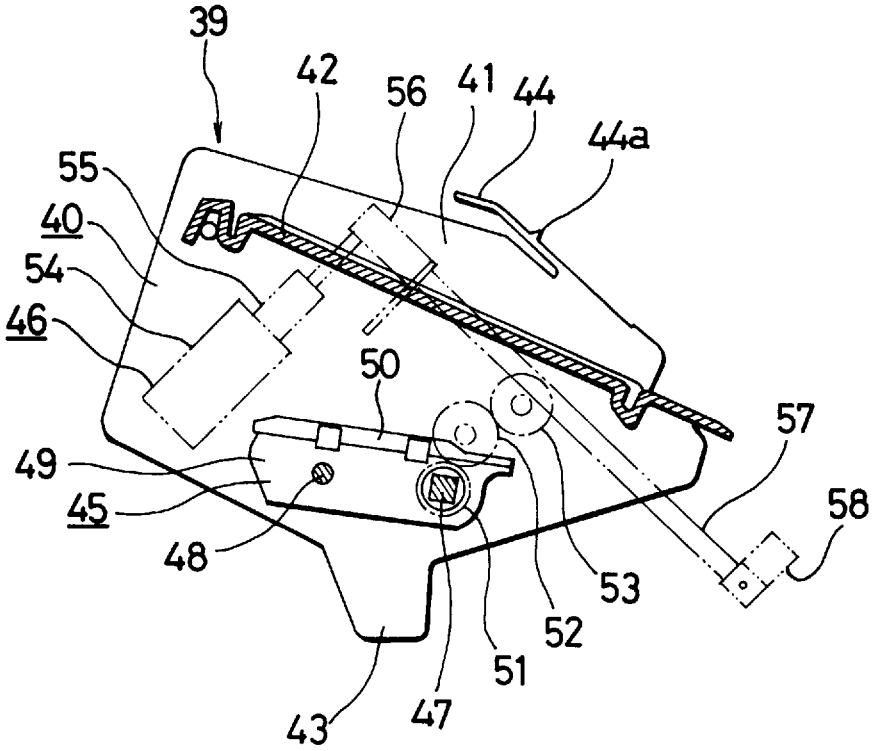
FIG. 4 is a vertical sectional side view of the tractor device.

As shown in FIGS. 2 and 3, an opening 36 is formed on the front surface of the printer body 2. There is provided in the opening 36 an external device connecting portion 203 allowing selective attachment and detachment of either a tractor device 39 or an automatic sheet feeder 59 to be hereinafter described. A support member 37 is provided at the lower end of the opening 36, and a pair of support members 38 each having a stop recess 38*a* are provided on the opposed sides of the upper portion of the opening 36. The tractor device 39 adapted to be mounted in the opening 36 of the printer body 2 is shown in FIG. 4. A tractor body 40 of the tractor device 39 has a pair of opposed side plates 41 and a manual paper feed table 42 for feeding a cut sheet of paper. The lower end of the tractor body 40 is formed with a projection 43 adapted to be supported by the support member 37 of the printer body 2. The opposite sides of the tractor body 40 are formed with a pair of elastic portions 44 adapted to come into surface contact with the pair of support members 38 of the printer body 2, respectively. Each elastic portion 44 has a projection 44*a* adapted to engage the stop recess 38*a* of each support member 38 in a clicking fashion.

The tractor body 40 is provided with an auxiliary tractor 45 and a second drive force selecting mechanism 46. The auxiliary tractor 45 includes a pair of right and left holders 49 slidably supported on a rotating shaft 47 and a guide shaft 48, a pulley (not shown) provided on each holder 49 so as to be driven by the rotating shaft 47, an endless belt (not shown) wound around each pulley and having a plurality of pins on the outer circumferential surface, and a paper presser 50 erectably mounted on each holder 49. A tractor gear 51 is fixedly mounted on one end of the rotating shaft 47. The tractor gear 51 is connected through an idler gear 52 to an input gear 53. The input gear 53 is provided outside of the tractor body 40 so as to mesh with the output gear 19 when the tractor body 40 is mounted in the opening 36 of the printer body 2.

The second drive force selecting mechanism 46 includes an arm 56 for converting a linear motion of a plunger 55 of a solenoid 54 into a rotary motion, a rod 57 rotating together with the arm 56, and a cam 58 fixed to the front end of the rod 57. As shown in FIG. 5(C), the cam 58 is positioned inside of the side plate 2*a* of the printer body 2 in the vicinity thereof when the tractor body 40 is mounted in the printer body 2. That is, the cam 58 is positioned so that when it is rotated clockwise by a given angle together with the rod 57, the cam 58 urges the shift gear 22 independently toward the idler gear 18. The side plate 2*a* is provided with an opening (not shown) for allowing pass of the cam 58.

Figure 6:
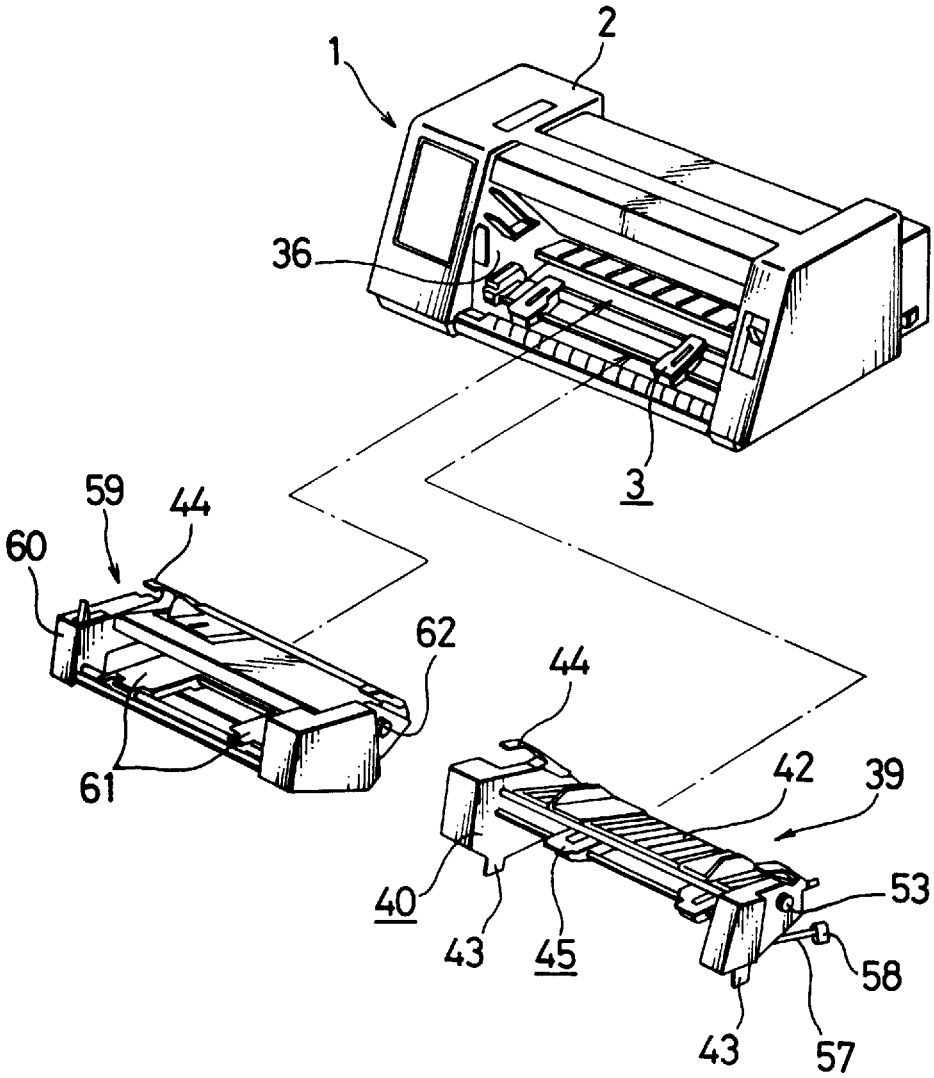
FIG. 6 is an exploded perspective view showing a relation between the printer and either an automatic sheet feeder or the tractor device to be selectively mounted into the printer.

As shown in FIG. 6, the automatic sheet feeder 59 adapted to be selectively mounted in the printer body 2 has a housing 60 similar in size and shape to the tractor body 40 of the tractor device 39. The housing 60 includes a pair of cut sheet guides 61 for guiding the opposite side edges of cut sheets of paper, an input gear 62 provided on one side of the housing 60 and adapted to mesh with the output gear 19 (see FIGS. 2 and 3) in the printer body 2, and a paper feed roller (not shown) connected to the input gear 62. The opposite sides of the housing 60 are formed with a pair of elastic portions 44 adapted to respectively come into surface contact with the pair of support members 38 provided in the printer body 2. As similar to the tractor device 39, the automatic sheet feeder 59 is detachably mounted in the opening 36 of the printer body 2 by the external device connecting portion 203.

In operation, when a cut sheet 63 is intended to be fed as shown in FIG. 2, the operating member 27 is pivoted upward to thereby downward slide the slider cam 25. At this time, the projection 35 of the slider cam 25 urges the conical projection 34 of the shift gear 22 as shown in FIG. 5(A), thereby making the shift gear 22 mesh with the idler gear 18. That is, in FIG. 2, the shift gear 22 is maintained in such a condition that the rotation transmitted from the drive gear 16 to the transmitting gear 14 is transmitted through the shift gear 22 and the idler gear 18 to the output gear 19. Since the drive rollers 10 and 11 are normally connected to the drive gear 16, the rotation of the drive gear 16 causes rotation of both the drive rollers 10 and 11 and the output gear 19. Further, the operation of the operating member 27 is interlocked with the operation of the operating member 28. That is, when the slider cam 25 is slid downward, the engagement of the projection 31 of the slider cam 25 with the pin 30 of the operating member 28 is canceled. As a result, the operating member 28 is pivoted clockwise about the support shaft 29 by the biasing force of biasing means (not shown), and the pinch roller 12 is accordingly biased by the biasing force of biasing means (not shown) to come into pressure contact with the drive roller 10. Accordingly, the cut sheet 63 is pressed between the drive roller 10 and the pinch roller 12 and between the drive roller 11 and the pinch roller 13, and is then fed to the printing mechanism in the printer body 2. In feeding the cut sheet 63, the drive force is transmitted to the output gear 19. Accordingly, the automatic sheet feeder 59 may be mounted in the printer body 2 so as to transmit the drive force from the output gear 19 to the input gear 62, thus effecting automatic sheet feed. Of course, the cut sheet 63 may be fed manually rather than by using the automatic sheet feeder 59.

When a continuous sheet 64 is intended to be fed by driving only the permanent tractor 3 provided in the printer body 2 as shown in FIG. 3, the operating member 27 is pivoted downward to thereby upward slide the slider cam 25. At this time, the projection 35 of the slider cam 25 is retracted from the conical projection 34 of the shift gear 22. As a result, the shift gear 22 is axially moved by the biasing force of the spring 33 to come into mesh with the input gear 9 of the permanent tractor 3. That is, in FIG. 3, the shift gear 22 is maintained in such a condition that the rotation transmitted from the drive gear 16 to the transmitting gear 14 is transmitted through the shift gear 22 to the input gear 9. At this time, the operating member 28 is also operated in interlocking relationship with the operation of the operating member 27. That is, when the slider cam 25 is upwardly slid, the projection 31 of the slider cam 25 urges the pin 30 of the operating member 28 to counterclockwise pivot the operating member 28 about the support shaft 29. As a result, the pinch roller 12 is separated from the drive roller 10. Thus, the continuous sheet 64 can be fed by the permanent tractor 3 regardless of the peripheral speed of the drive roller 10.

Figure 1:
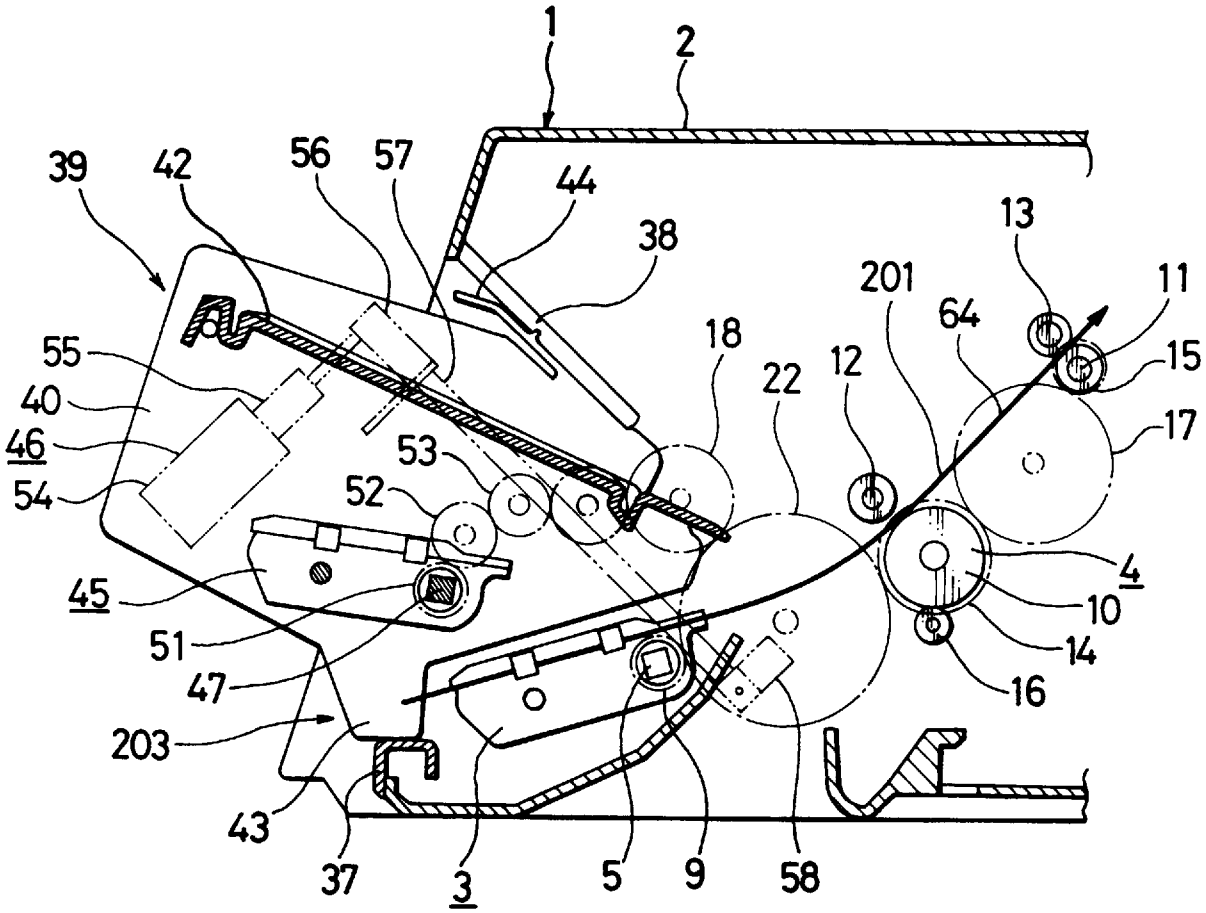
FIG. 1 is a vertical sectional side view of a first preferred embodiment of the present invention, showing a condition where a tractor device is mounted in a printer.
Figure 7:
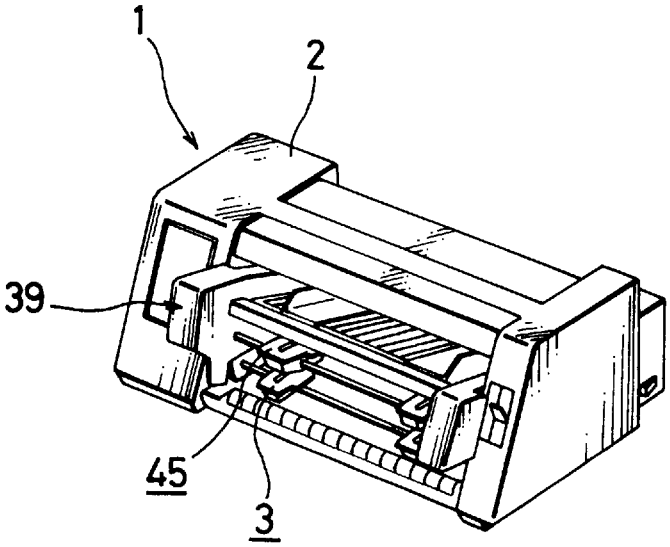
FIG. 7 is a perspective view showing a condition where the tractor device is mounted in the printer.

In selectively using two kinds of continuous sheets 64, the tractor device 39 is mounted into the opening 36 of the printer body 2 as shown in FIGS. 1 and 7 in the condition that the pinch roller 12 is separated from the drive roller 10 by downward pivoting the operating member 27. In the mounted condition of the tractor device 39, the input gear 53 of the tractor device 39 is in mesh with the output gear 19 of the printer body 2. However, the rotation of the drive gear 16 is not transmitted to the output gear 19, but is transmitted to the input gear 9 of the permanent tractor 3. Accordingly, one of the two kinds of continuous sheets 64 can be fed by the permanent tractor 3.

In feeding the other kind of continuous sheet 64 by using the auxiliary tractor 45 of the tractor device 39 in the condition shown in FIG. 1, the solenoid 54 is excited. Accordingly, the plunger 55 is retracted to thereby pivot the arm 56, with the result that the rod 57 and the cam 58 are rotated together clockwise as viewed in FIG. 5(C). Accordingly, the shift gear 22 only is independently urged by the cam 58 without displacing the operating member 28, and is brought into mesh with the idler gear 18 as shown by a phantom line in FIG. 5(*c*). As a result, the rotation transmitted from the driver roller 16 to the shift gear 22 is transmitted through the idler gear 18 to the output gear 19, thereby driving the auxiliary tractor 45 of the tractor device 39. Thus, the other kind of continuous sheet 64 can be fed by the auxiliary tractor 45.

Further, the peripheral speed of the drive rollers 10 and 11 may be set slightly higher than the peripheral speed of the tractor 3 or 45. In this case, the continuous sheet 64 fed by the tractor 3 or 45 travels under tension applied by the drive rollers 10 and 11 and the pinch rollers 12 and 13. Further, the selection of the drive force to either the permanent tractor 3 or the auxiliary tractor 45 may be effected by operating the operating member 27 in the printer 1 to transmit the rotation transmitted from the drive gear 16 to the transmitting gear 14, through the shift gear 22 to either the input gear 9 or the input gear 53.

As described above, when the optional tractor device 39 is mounted in the printer 1, the permanent tractor 3 in the printer 1 or the auxiliary tractor 45 in the tractor device 39 can be selectively driven. Accordingly, the permanent tractor 3 in the printer 1 is useful enough in spite of the use of the optional tractor device 39. In connection with this, the number of auxiliary tractors to be provided in the optional tractor device 39 can be reduced to thereby allow a reduction in cost of not only the printer 1 but also the optional tractor device 39. In addition, the optional tractor device 39 can be driven by utilizing the output gear 19 for driving the automatic sheet feeder 59. Accordingly, the power transmitting mechanism can be simplified to thereby reduce the size of the printer 1, especially, the width of the printer 1.

Further, even in the mounted condition of the optional tractor device 39, the cut sheet 63 can be fed by the manual paper feed table 42 provided on the upper surface of the tractor body 40. In this case, the pinch roller 12 is brought into pressure contact with the drive roller 10 by operating the operating member 27 of the printer body 2.

Now, a second preferred embodiment of the present invention will be described with reference to FIGS. 8 to 14. The second preferred embodiment is different from the first preferred embodiment only in terms of the structure displacing the shift gear 22. The other structures are similar to those in the first preferred embodiment, so that the same parts as those in the first preferred embodiment will be denoted by the same reference numerals, and the description thereof will be omitted.

A slider cam 65 as the drive force selecting mechanism 20 is provided on one side of the printer body 2 so as to be slid linearly by the operation of the operating member 27. The slider cam 65 is composed of a slider 66 connected to the operating member 27 and a cam member 67 constituting the second drive force selecting mechanism 46 slidably held by the slider 66 so as to slide along the sliding direction of the slider 66. The cam member 67 is biased in one direction by a torsion coil spring 68 (see FIGS. 10 and 12), and an end surface 69 of the cam member 67 normally abuts against a stop surface 70 of the slider 66, so that the cam member 67 is normally moved together with the slider 66. As similar to the slider cam 25 in the first preferred embodiment, the slider 66 has an elongated hole 24 guided in linear motion by the support shaft 21 supporting the shift gear 22 and the support shaft 23 supporting the idler gear 18, a projection 31 for urging the pin 30 of the operating member 28, and a recess 32 for retracting the pin 30. The cam member 67 is guided in linear motion by a guide (not shown) formed on a frame (not shown) of the printer body 2.

The cam member 67 and the slider 66 are formed with side projections 71 for urging the side surface of the shift gear 22. Each side projection 71 has an inclined portion 72 gradually decreasing in projection height toward the right as viewed in FIG. 10 or toward the bottom as viewed in FIGS. 12 to 14(*c*). That is, the cam member 67 and the slider 66 having the side projections 71 constitute a translation cam mechanism.

Figure 11:
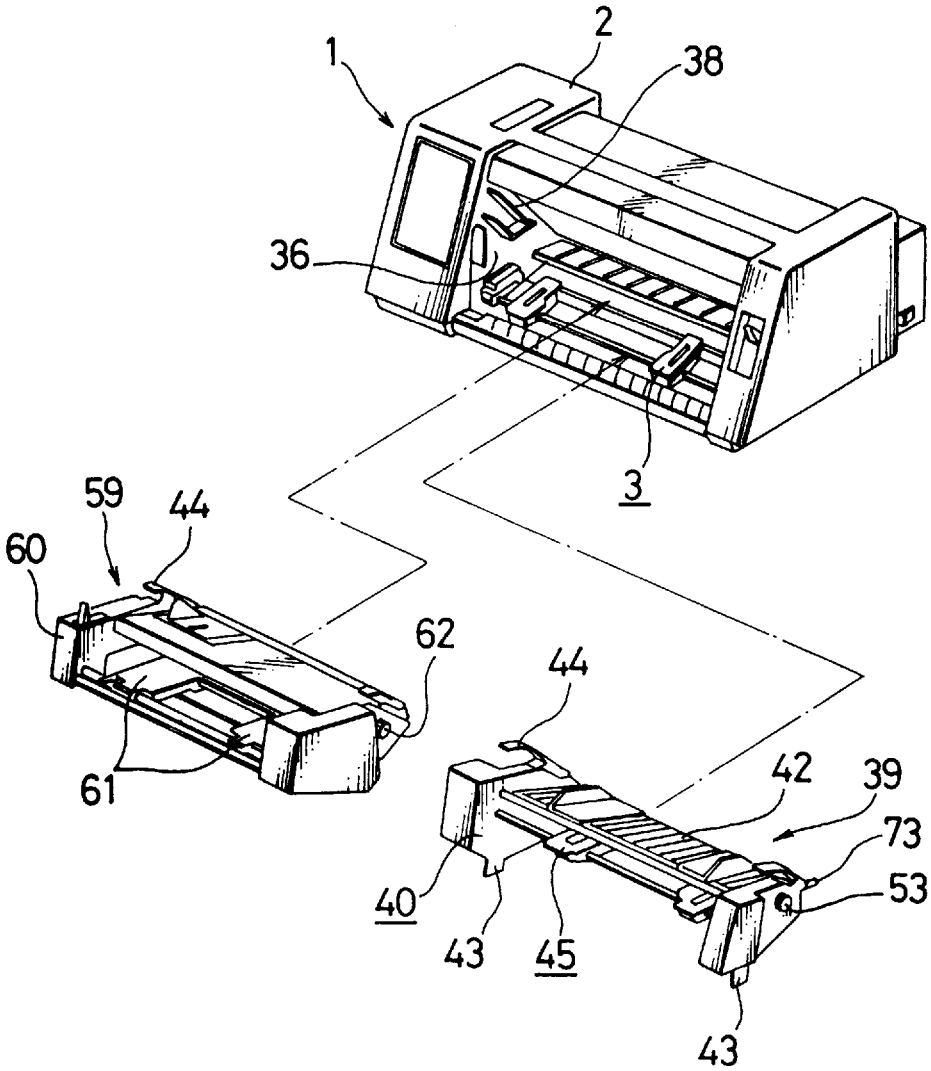
FIG. 11 is an exploded perspective view showing a relation between the printer and either an automatic sheet feeder or the tractor device to be selectively mounted into the printer.

As shown in FIG. 11, a selector arm 73 as a part of the second operating member is provided on one side of the tractor body 40. The selector arm 73 is adapted to move in the same direction as the direction of insertion of the tractor body 40 into the printer body 2 so as to urge the cam member 67 in receipt of power from a driving source such as a solenoid provided in the tractor body 40.

Figure 8:
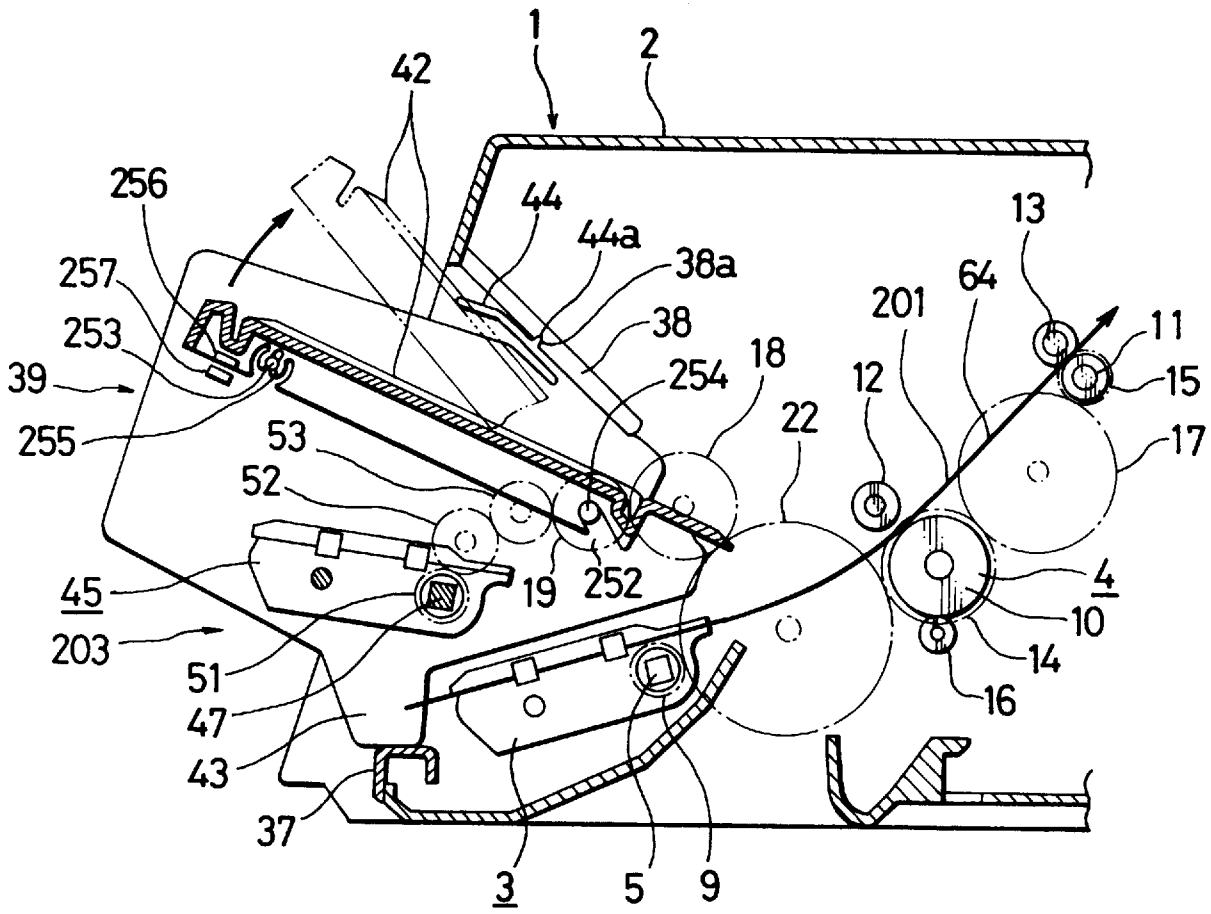
FIG. 8 is a vertical sectional side view of a second preferred embodiment of the present invention, showing a condition where a tractor device is mounted in a printer.
Figure 9:
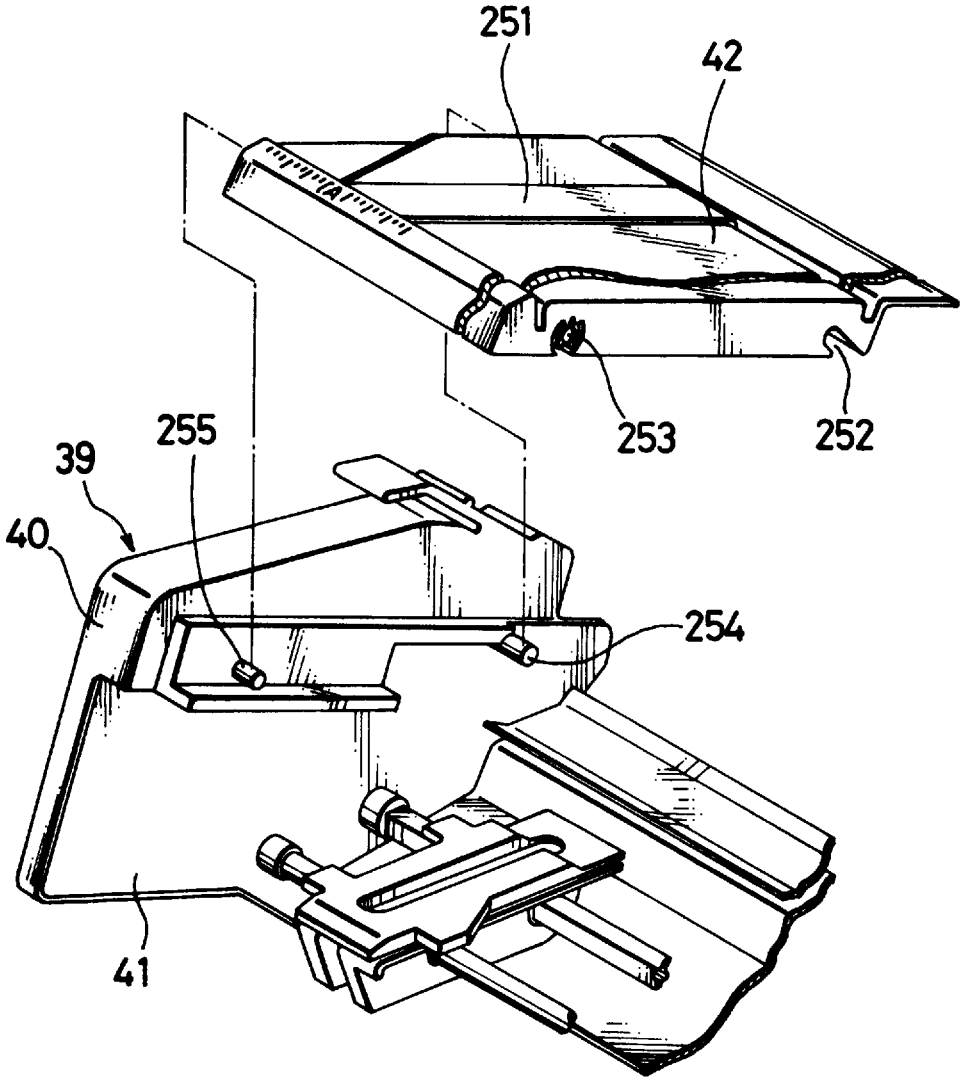
FIG. 9 is an exploded perspective view showing a support structure for a manual paper feed table in the tractor device.
Figure 10:
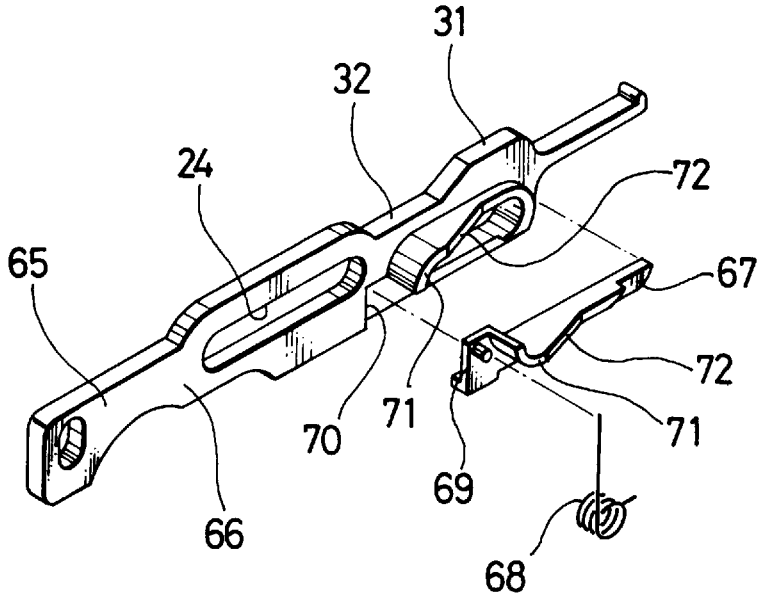
FIG. 10 is an exploded perspective view showing a relation between a slider and a cam member.

The manual paper feed table 42 provided in the tractor device 39 will now be described. As shown in FIG. 9, the manual paper feed table 42 is provided with a pair of right and left guides 251 for guiding the opposite side edge of a cut sheet. The guides 251 are laterally slidable for position adjustment. The lower portion of the manual paper feed table 42 on each of the right and left sides is formed with a groove 252 having a lower opening and a bearing 253 having a lower opening. The groove 252 is inclined toward the rear end of the table 42 to be forwarded to the printer body 2. The bearing 253 is elastically deformable. On the other hand, a boss 254 adapted to be engaged with the groove 252 and a boss 255 adapted to be press-fitted with the bearing 253 are projected from the inner surface of each side plate 41 of the tractor body 40. As shown in FIG. 8, a permanent magnet 256 is fixed to the table 42, and a sensor (reed switch) 257 for detecting a condition that the table 42 has been mounted in a proper position when the permanent magnet 256 has come close to the sensor 257 is provided in the tractor body 40.

Figure 12:
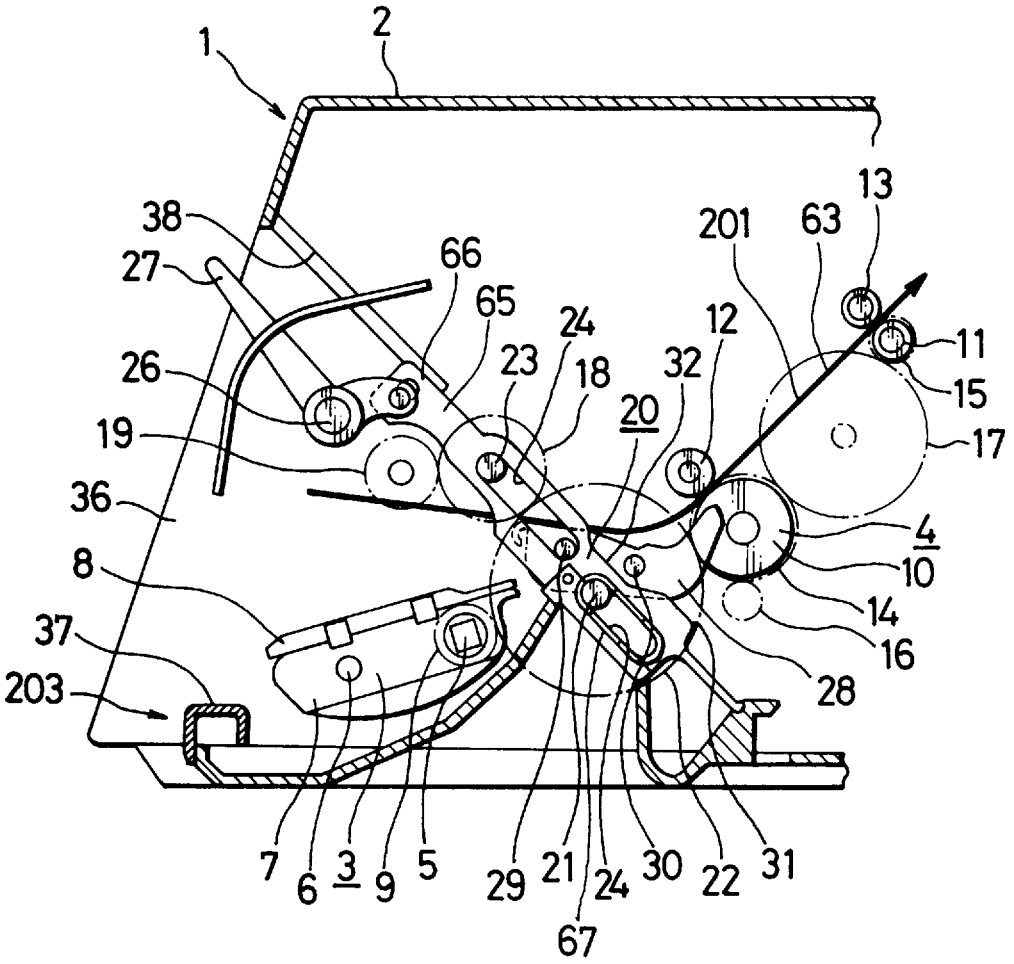
FIG. 12 is a vertical sectional side view showing a condition where a cut sheet of paper is fed by the printer only.
Figure 14A:
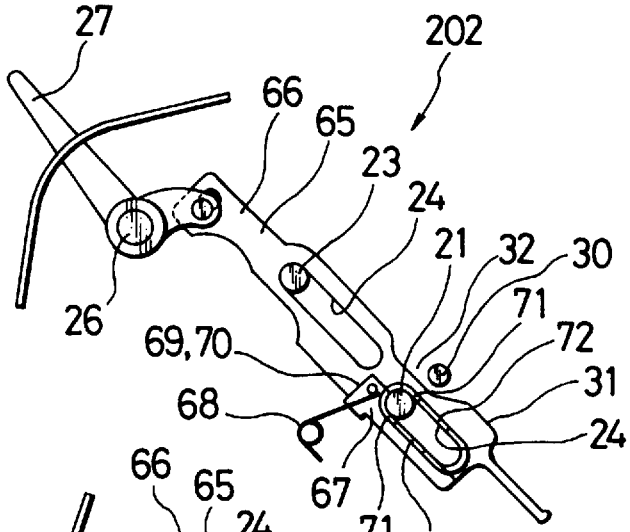
FIG. 14(A) is a side view of a slider cam in the case of using a friction feed mechanism.

In operation, when the cut sheet 63 is intended to be fed, the operating member 27 is pivoted upward as shown in FIGS. 12 and 14(A). Accordingly, the slider 66 and the cam member 67 are slid downward together. At this time, the side projections 71 of the slider 66 and the cam member 67 urge the side surface of the shift gear 22, thereby making the shift gear 22 mesh with the idler gear 18. This condition corresponds to the condition shown in FIG. 5(A) of the first preferred embodiment. As a result, the shift gear 22 is maintained in the condition that the rotation transmitted from the drive gear 16 to the transmitting gear 14 is transmitted through the shift gear 22 and the idler gear 18 to the output gear 19. Further, at this time, the operating member 28 is operated in interlocking relationship with the operation of the operating member 27. That is, since the slider 66 and the cam member 67 are slid downward, the projection 31 of the slider 66 is released from the pin 30 of the operating member 28, resulting in clockwise rotation of the operating member 28 about the support shaft 29 by the biasing force of biasing means (not shown). As a result, the pinch roller 12 is brought into pressure contact with the drive roller 10 by the biasing force of biasing means (not shown). Accordingly, the cut sheet 63 is pressed between the drive roller 10 and the pinch roller 12 and between the drive roller 11 and the pinch roller 13, and is fed into the printing mechanism.

Figure 13:
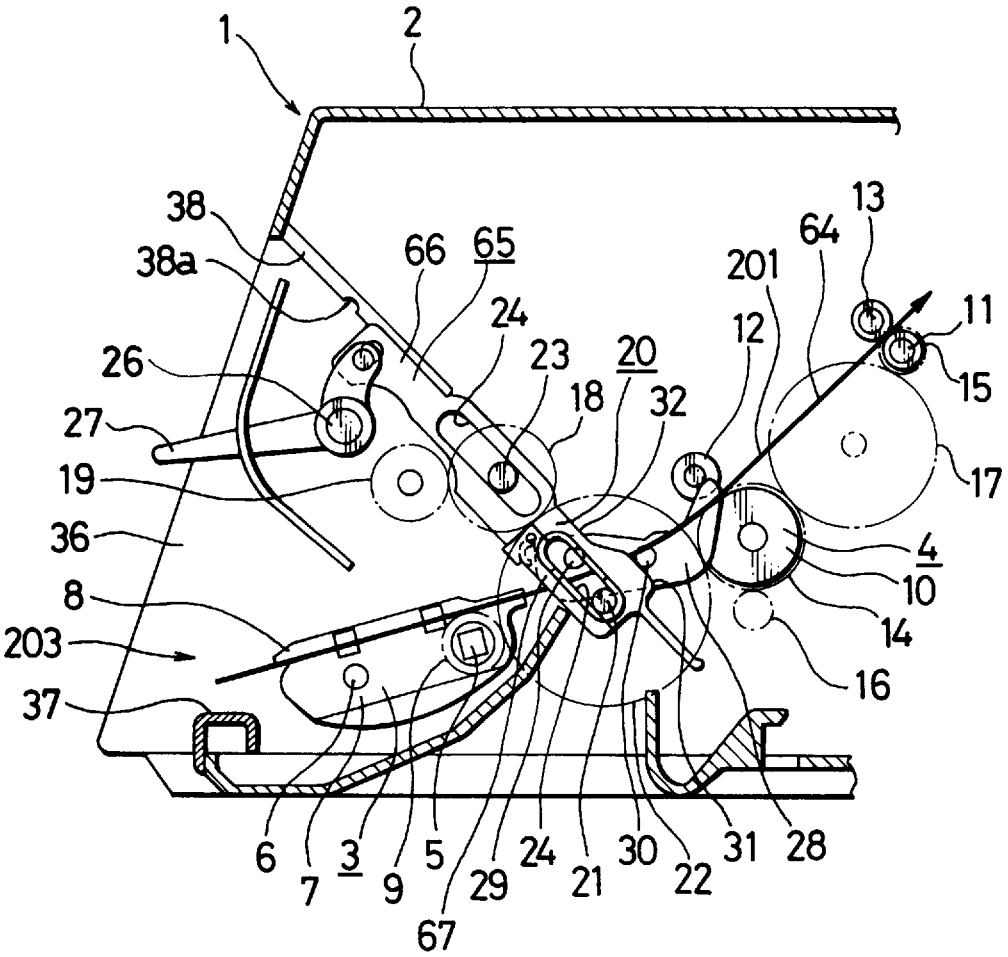
FIG. 13 is a vertical sectional side view showing a condition where a continuous sheet of paper is fed by the printer only.
Figure 14B:
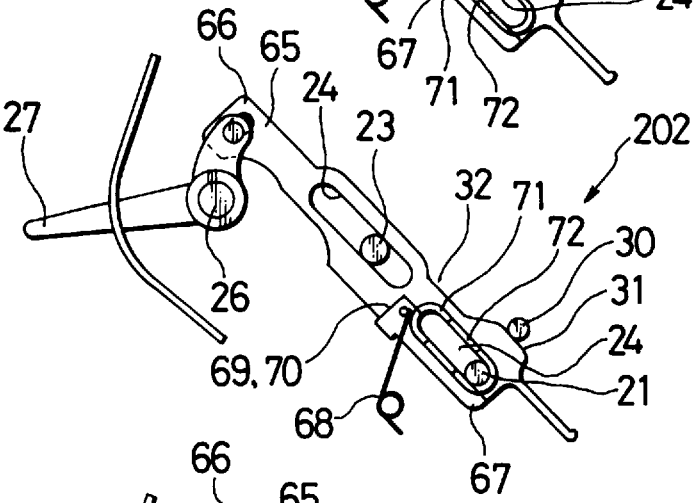
FIG. 14(B) is a side view of the slider cam in the case of using a permanent tractor.

When the continuous sheet 64 is intended to be fed by driving only the permanent tractor 3 in the printer body 2, the operating member 27 is pivoted downward as shown in FIGS. 13 and 14(B). Accordingly, the slider 66 and the cam member 67 are slid upward together. At this time, the side projections 71 of the slider 66 and the cam member 67 are separated from the shift gear 22, and the shift gear 22 is accordingly moved axially by the biasing force of the spring 33 to come into mesh with the input gear 9 of the permanent tractor 3. This condition corresponds to the condition shown in FIG. 5(B) of the first preferred embodiment. As a result, the shift gear 22 is maintained in the condition that the rotation transmitted from the drive gear 16 to the transmitting gear 14 is transmitted through the shift gear 22 to the input gear 9. At this time, the operating member 28 is also operated in interlocking relationship with the operation of the operating member 27. That is, since the slider 66 and the cam member 67 are upward slid together, the projection 31 of the slider 66 urges the pin 30 of the operating member 28 to thereby counterclockwise rotate the operating member 28 about the support shaft 29. As a result, the pinch roller 12 is separated from the drive roller 10. Thus, the continuous sheet 64 can be fed by the permanent tractor 3 regardless of the peripheral speed of the drive rollers 10 and 11.

In selectively using two kinds of continuous sheets 64, the tractor device 39 is mounted into the opening 36 of the printer body 2 in the condition that the pinch roller 12 is separated from the drive roller 10 by downward pivoting the operating member 27. In this condition, the input gear 53 of the tractor device 39 is in mesh with the output gear 19 of the printer body 2. However, the rotation of the drive gear 16 is not transmitted to the output gear 19, but is transmitted to the input gear 9 of the permanent tractor 3. Therefore, one of the two kinds of continuous sheets 64 can be fed by the permanent tractor 3.

In feeding the other kind of continuous sheet 64 by using the auxiliary tractor 45 of the tractor device 39, the selector arm 73 (see FIG. 11) is projected forward by the control of the tractor device 39. Accordingly, the cam member 67 is urged by the selector arm 73 to move away from the stop surface 70 of the slider 66 against the biasing force of the torsion coil spring 68. At this time, the side projection 71 of the cam member 67 urges the side surface of the shift gear 22, and the shift gear 22 is accordingly brought into mesh with the idler gear 18. This condition corresponds to the condition shown in FIG. 5(A) of the first preferred embodiment. As a result, the rotation transmitted from the drive gear 16 to the shift gear 22 is transmitted through the idler gear 18 to the output gear 19, thereby driving the auxiliary tractor 45 of the tractor device 39. Thus, the other kind of continuous sheet 64 can be fed by the auxiliary tractor 45.

In mounting the tractor body 40 into the printer body 2, the tractor body 40 is positioned by the elastic portions 44 thereof and the support members 38 of the printer body 2, and the direction of mounting the tractor body 40 is the same as the direction of displacing the selector arm 73. Therefore, even if the selector arm 73 interferes with any structures in the printer 1 when mounting the tractor body 40 into the printer 1, any external forces in the directions other than the given displacement direction are not applied to the selector arm 73, so that damage to the selector arm 73 can be prevented.

Figure 14C:
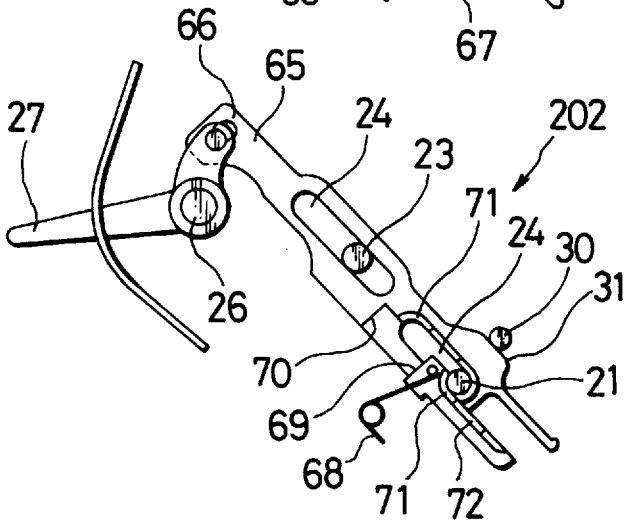
FIG. 14(C) is a side view of the slider cam in the case of using an auxiliary tractor.

In the mounted condition of the tractor body 40 in the printer body 2, when the operating member 27 is pivoted upward to downward slide the slider cam 65 as shown in FIG. 14(*a*), the pinch roller 12 comes to pressure contact with the drive roller 10. In this condition, the cut sheet can be fed from the manual paper feed table 42 of the tractor body 40 to between the drive roller 10 and the pinch roller 12. Accordingly, the use mode of selectively using the permanent tractor 3 or the auxiliary tractor 45 can be smoothly shifted to the use mode of feeding the cut sheet without the need for removing the tractor body 40 from the printer body 2.

While the manual paper feed table 42 functions also to insulate a printing noise, the space over the auxiliary tractor 45 can be opened by first removing the bearings 253 of the table 42 from the bosses 255 of the printer body 40 and next upward pivoting the table 42 about the bosses 254 to retract the table 42 from the auxiliary tractor 45 as shown by a phantom line in FIG. 8. Further, the table 42 can be completely removed from the tractor body 40 by disengaging the grooves 252 of the table 42 from the bosses 254 of the tractor body 40 in the above retracted condition, thereby more widely opening the space over the auxiliary tractor 45. Accordingly, the continuous sheet 64 can be easily set on the auxiliary tractor 45.

In this case, the retracted condition of the table 42 can be confirmed by a detection signal from the sensor 257 having detected a condition where the permanent magnet 256 has been moved away from the sensor 257. Further, a paper sensor (not shown) is provided in the printer 1 to detect that the continuous sheet 64 fed from the permanent tractor 3 in the printer body 2 has reached the friction feed mechanism 4. In this preferred embodiment, when detection signals from the paper sensor and the sensor 257 are input into a controller (not shown) in the printer 1, the controller controls to reversely rotate the permanent tractor 3 for a given time period. Accordingly, when the continuous sheet 64 from the permanent tractor 3 is present in the printer body 2, the continuous sheet 64 in the printer body 2 can be quickly removed by simply retracting the table 42 to thereby reversely rotate the permanent tractor 3, in preparation for setting of the other kind of continuous sheet 64 to the auxiliary tractor 45.

Figure 15:
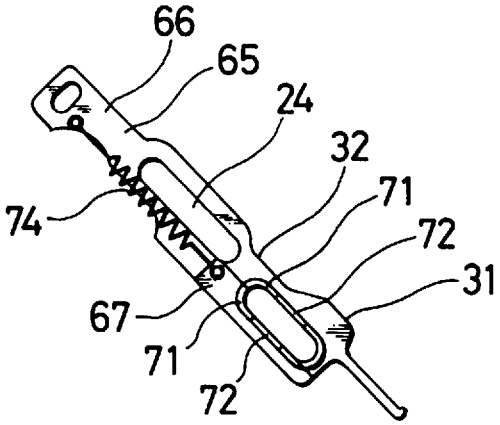
FIG. 15 is a side view showing another preferred embodiment of means for biasing the cam member.
Figure 16:
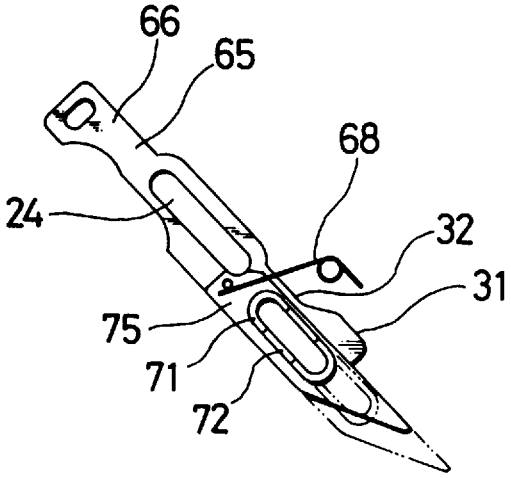
FIG. 16 is a side view showing a modification of the slider cam.
Figure 17:
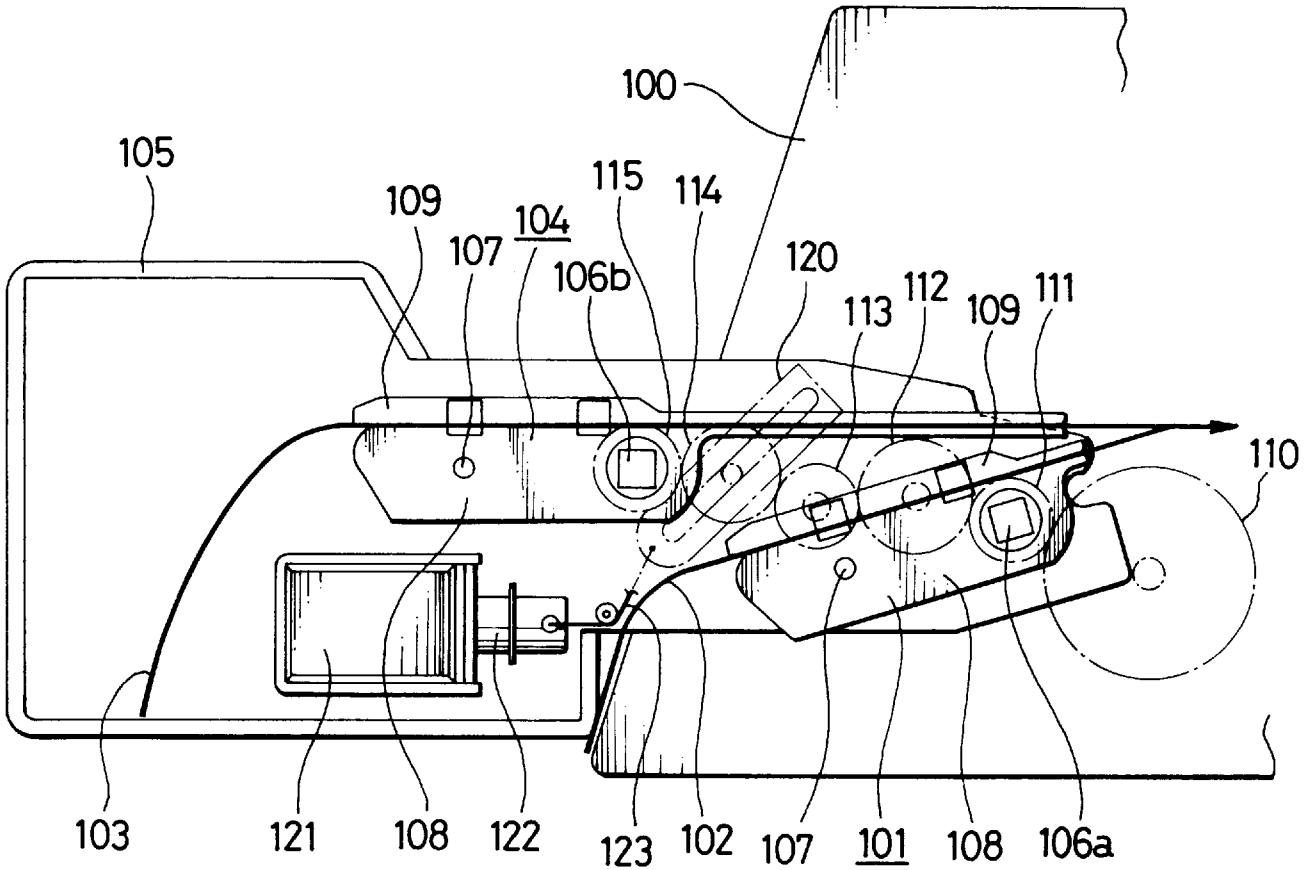
FIG. 17 is a vertical sectional side view showing the prior art.
Figure 18:
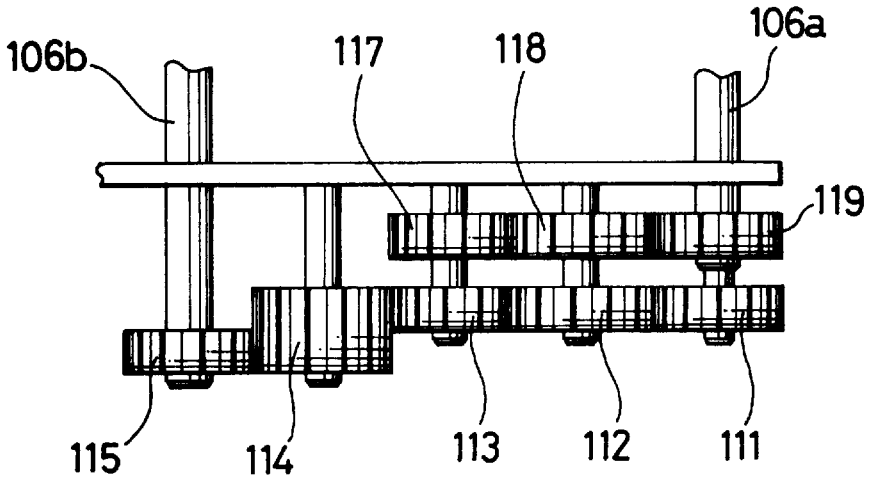
FIG. 18 is a plan view showing an arrangement of gears for transmitting a drive force to a tractor.

Although the torsion coil spring 68 is used to bias the cam member 67 in this preferred embodiment, a tension coil spring 74 may be provided under tension between the slider 66 and the cam member 67 as shown in FIG. 15. Further, in this preferred embodiment, the side projections 71 are formed on both the slider 66 and the cam member 67, and when the slider 66 and the cam member 67 are slid downward, the shift gear 22 is shifted by the side projections 71 of the slider 66 and the cam member 67, whereas when only the cam member 67 is slid downward, the shift gear 22 is shifted by the side projection 71 of only the cam member 67. As a modification as shown in FIG. 16, the side projection 71 may be formed on only a cam member 75 slidably held on the slider 66. In this modification, the torsion coil spring 68 for biasing the cam member 75 is located opposite to the position shown in FIG. 15 with respect to the slider 66 in relation to the locations of parts.

What is claimed is:

1. A printer allowing attachment and detachment of an external device for enriching the kind of a paper feed system, comprising:

a printing mechanism;

paper guide path communicating with said printing mechanism;

a driving source for said paper feed system;

a permanent tractor located so as to communicate with said paper guide path, said permanent tractor having a first input gear connected to an output shaft of said driving source, thereby applying a feeding force to a continuous sheet of paper;

an output gear connected to said output shaft of said driving source;

a drive force selecting mechanism selectively transmitting a drive force from said driving source to one of said first input gear of said permanent tractor and said output gear;

an operating member connected to said drive force selecting mechanism and operating said drive force selecting mechanism; and an external device connecting portion which selectively allows at substantially the same location attachment and detachment of one of an automatic sheet feeder successively feeding a plurality of cut sheets of paper and a tractor device feeding a continuous sheet of paper so that a paper feed mechanism of one of said automatic sheet feeder and said tractor device communicates with said paper guide path at substantially the same location, wherein said output gear is connected to a and drivingly engages second input gear of said paper feed mechanism of said one of said automatic sheet feeder and said tractor device.

2. A printer as recited in claim 1, wherein said drive force selecting mechanism comprises a shift gear adapted to be axially slid to thereby selectively mesh with one of said first input gear of said permanent tractor and said output gear, and a mechanism for sliding said shift gear according to an operation of said operating member.

3. A printer as recited in claim 2, wherein said mechanism for sliding said shift gear comprises biasing means for biasing said shift gear in one direction to make said shift gear selectively mesh with one of said first input gear of said permanent tractor and said output gear, and a mechanism for driving said shift gear against a biasing force of said biasing means.

4. A printer as recited in claim 3, wherein said mechanism for sliding said shift gear against the biasing force of said biasing means comprises a cam mechanism.

5. A printer as recited in claim 4, wherein said cam mechanism comprises a translation cam mechanism.

6. A printer as recited in claim 5, wherein said operating member is pivotably operated, and a pivotal motion of said operating member is converted into a linear motion of said translation cam.

7. A printer as recited in claim 1, wherein said drive force selecting mechanism comprises a shift gear adapted to be axially slid and a mechanism for sliding said shift gear to make said shift gear selectively mesh with one of said first input gear of said permanent tractor and said output gear.

8. A printer as recited in claim 7, wherein said shift gear is biased in one direction to selectively mesh with one of said first input gear of said permanent tractor and said output gear.

9. A printer as recited in claim 8, wherein said mechanism for sliding said shift gear comprises a cam mechanism.

10. A printer as recited in claim 9, wherein said cam mechanism comprises a translation cam mechanism.

11. A printer as recited in claim 10, wherein said operating member is pivotably operated, and a pivotal motion of said operating member is converted into a linear motion of said translation cam.

12. A printer as recited in claim 1, wherein said external device connecting portion comprises means for fixing said external device in a clicking fashion.

13. A printer as recited in claim 12, wherein said external device connecting portion further comprises means adapted to come into surface contact with said external device.

14. A printer as recited in claim 13, wherein said means adapted to come into surface contact with said external device is provided about said means for fixing said external device in the clicking fashion.

15. A printer as claimed in claim 1, wherein said drive force selecting mechanism comprises an axially slidable drive mechanism.

16. A printer allowing attachment and detachment of an external device for enriching the kind of a paper feed system, comprising:

a printing mechanism;

a paper guide path communicating with said printing mechanism;

driving source for a paper feed system;

a friction feed mechanism adapted to receive a drive force from said driving source, said friction feed mechanism comprising a drive roller and a pinch roller kept in separable contact with each other through said paper guide path;

a permanent tractor located so as to communicate with said paper guide path, said permanent tractor having a first input gear connected to an output shaft of said driving source, thereby applying a feeding force to a continuous sheet of paper;

an output gear connected to said output shaft of said driving source;

a drive force selecting mechanism selectively transmitting a drive force from said driving source to one of said first input gear of said permanent tractor and said output gear;

an operating member connected to said drive force selecting mechanism and operating said drive force selecting mechanism; and an external device connecting portion which selectively allows at substantially the same location attachment and detachment of one of an automatic sheet feeder successively feeding a plurality of cut sheets of paper and a tractor device feeding a continuous sheet of paper so that a paper feed mechanism of one of said automatic sheet feeder and said tractor device communicates with said paper guide path at substantially the same location, and said output gear is connected to and drivingly engages a second input gear of said paper feed mechanism of said one of said automatic sheet feeder and said tractor device.

17. A printer as recited in claim 16, further comprising a separating mechanism for separating said drive roller and said pinch roller from each other in interlocking relationship with an operation that said operating member operates said drive force selecting mechanism to connect said drive source to said first input gear of said permanent tractor.

18. A printer as recited in claim 17, wherein said separating mechanism comprises a cam mechanism.

19. A printer as recited in claim 17, wherein said drive force selecting mechanism comprises a shift gear adapted to be axially slid and a mechanism for sliding said shift gear to make said shift gear selectively mesh with one of said first input gear of said permanent tractor and said output gear.

20. A printer as recited in claim 19, wherein said shift gear is biased in one direction to selectively mesh with one of said first input gear of said permanent tractor and said output gear.

21. A printer as recited in claim 20, wherein said mechanism for sliding said shift gear comprises a cam mechanism.

22. A printer as recited in claim 21, wherein said cam mechanism comprises a translation cam mechanism.

23. A printer as recited in claim 22, wherein said operating member is pivotably operated, and a pivotal motion of said operating member is converted into a linear motion of said translation cam.

24. A printer as recited in claim 17, wherein said tractor device is adapted to be mounted into said printer by said external device connecting portion and has an auxiliary tractor provided with an auxiliary tractor input gear adapted to mesh with said output gear when said tractor device is mounted into said printer to communicate with said paper guide path, said tractor device further having a second drive force selecting mechanism for selectively transmitting a drive force from said driving source to one of said first input gear of said permanent tractor and said output gear, independently of said drive force selecting mechanism.

25. A printer as recited in claim 19, wherein said tractor device is adapted to be mounted into said printer by said external device connecting portion and has an auxiliary tractor provided with an auxiliary tractor input gear adapted to mesh with said output gear when said tractor device is mounted into said printer to communicate with said paper guide path, said tractor device further having a second drive force selecting mechanism for independently sliding said shift gear.

26. A printer as recited in claim 17, further comprising a second drive force selecting mechanism for selectively transmitting a drive force from said driving source to one of said first input gear of said permanent tractor and said output gear, independently of said drive force selecting mechanism.

27. A printer as recited in claim 19, further comprising a second drive force selecting mechanism for independently sliding said shift gear.

28. A printer as recited in claim 27, wherein said mechanism for sliding said shift gear comprises a translation cam mechanism, and said second drive force selecting mechanism comprises a second translation cam mechanism slidably mounted on said translation cam mechanism so as to be slid in the same direction as a direction of displacement of said translation cam mechanism.

29. A printer as recited in claim 28, wherein said tractor device is adapted to be mounted into said printer by said external device connecting portion and has an auxiliary tractor provided with an auxiliary tractor input gear adapted to mesh with said output gear when said tractor device is mounted into said printer to communicate with said paper guide path, said tractor device further having a second operating member for selectively operating said second translation cam mechanism.

30. A printer as recited in claim 29, wherein said second operating member comprises a selector arm provided on said tractor device so as to be retractably projected in the direction of displacement of said second translation cam mechanism, and said second translation cam mechanism is biased toward said selector arm.

31. A printer recited in claim 16, wherein said tractor device is mounted to said printer, the printer further comprising a manual paper feed table for supporting a cut sheet of paper, said manual paper feed table communicating with said friction feed mechanism in said paper guide path when said tractor device is mounted into said printer.

32. A printer as recited in claim 31, wherein said tractor device comprises an auxiliary tractor for feeding a continuous sheet of paper in said paper guide path, and wherein said manual paper feed table is pivotably mounted above said auxiliary tractor.

33. A printer as claimed in claim 16, wherein said drive force selecting mechanism comprises an axially slidable drive mechanism.

34. A tractor device as claimed in claim 25, wherein said drive mechanism comprises an axially slidable drive force selecting mechanism and an operating member connected to said drive force mechanism to axially slide said drive force selecting mechanism.

35. A tractor device adapted to be detachably mounted in a printer including a printing mechanism, a permanent tractor feeding a continuous sheet of paper to said printing mechanism, and an automatic sheet feeder detachably mounted at a prescribed location and successively feeding a plurality of cut sheets of paper to a paper guide path which communicates with said printing mechanism, said tractor device comprising:

a tractor body detachably mountable into a printer at the prescribed location in place of said automatic sheet feeder;

an auxiliary tractor mounted in said tractor body, said auxiliary tractor feeding a continuous sheet of paper to said paper guide path of the printing mechanism of said printer; and an auxiliary tractor input gear connected to and driving said auxiliary tractor, said auxiliary tractor input gear being connectable to a drive mechanism provided in said printer, said drive mechanism driving said automatic sheet feeder when said tractor body is mounted into said printer.

36. A tractor device as recited in claim 35, wherein said printer further includes a paper guide path communicating with said printing mechanism and a friction feed mechanism provided in said paper feed path, said tractor device further comprising a manual paper feed table for supporting a cut sheet of paper, said manual paper feed table communicating with said friction feed mechanism when said tractor body is mounted into said printer.

37. A tractor device as recited in claim 36, wherein said manual paper feed table is pivotably mounted above said auxiliary tractor.

38. A tractor device adapted to be detachably mounted in a printer including a printing mechanism, a permanent tractor for feeding a continuous sheet of paper to said printing mechanism, an automatic sheet feeder detachably mounted at a prescribed location for successively feeding a plurality of cut sheets of paper to a paper guide path of said printing mechanism, and an operating member adapted to be operated to selectively transmit a drive force to one of said permanent tractor and said automatic sheet feeder, said tractor device comprising:

a tractor body detachably mountable into said printer at said prescribed location in place of said automatic sheet feeder;

an auxiliary tractor mounted in said tractor body, said auxiliary tractor feeding a continuous sheet of paper to the paper guide path of said printing mechanism of said printer; and an auxiliary tractor input gear connected to and driving said auxiliary tractor, said auxiliary tractor input gear being connectable to a drive mechanism provided in said printer and driving said automatic sheet feeder when said tractor body is mounted into said printer.

39. A tractor device as recited in claim 38, wherein said printer further includes a paper guide path communicating with said printing mechanism and a friction feed mechanism provided in said paper feed path, said tractor device further comprising a manual paper feed table for supporting a cut sheet of paper, said manual paper feed table communicating with said friction feed mechanism when said tractor body is mounted into said printer.

40. A tractor device as recited in claim 39, wherein the tractor body includes a support portion for supporting the manual paper feed table so that said manual paper feed table is pivotably mounted above said auxiliary tractor.

41. A tractor device as claimed in claim 38, wherein said drive mechanism comprises an axially slidable drive force selecting mechanism and an operating member connected to said drive force selecting mechanism to axially slide said drive force selecting mechanism.

* * * * *